US011253984B2

(12) United States Patent
Hsieh

(10) Patent No.: US 11,253,984 B2
(45) Date of Patent: Feb. 22, 2022

(54) VIBRATING WRENCH

(71) Applicant: KABO TOOL COMPANY, Taichung (TW)

(72) Inventor: Chih-Ching Hsieh, Taichung (TW)

(73) Assignee: Kabo Tool Company, Taichung (TW)

( * ) Notice: Subject to any disclaimer, the term of this patent is extended or adjusted under 35 U.S.C. 154(b) by 259 days.

(21) Appl. No.: 16/554,595

(22) Filed: Aug. 28, 2019

(65) Prior Publication Data

US 2020/0238488 A1 Jul. 30, 2020

Related U.S. Application Data

(60) Provisional application No. 62/796,096, filed on Jan. 24, 2019.

(51) Int. Cl.
*B25B 23/16* (2006.01)
*B25B 23/142* (2006.01)

(52) U.S. Cl.
CPC ..... *B25B 23/16* (2013.01); *B25B 23/1425* (2013.01)

(58) Field of Classification Search
CPC ..... B25B 23/142; B25B 23/1422; B25B 23/1425; B25B 23/1427; B25B 23/16
See application file for complete search history.

(56) References Cited

U.S. PATENT DOCUMENTS 4,958,541 A * 9/1990 Annis ..... B25B 23/1425 81/479
5,130,700 A * 7/1992 Annis ..... G01R 19/16576 340/665
6,681,663 B1 * 1/2004 Hsien ..... B08B 1/00 7/138
8,091,438 B1 * 1/2012 Huang ..... B25B 23/1425 73/862.23
10,335,935 B2 * 7/2019 Lee ..... B25B 23/1422
2013/0199344 A1 * 8/2013 Lee ..... B25B 23/1425 81/467
2020/0180126 A1 * 6/2020 Hsieh ..... B25B 23/1425

* cited by examiner

*Primary Examiner* — David B. Thomas
(74) *Attorney, Agent, or Firm* — CKC & Partners Co., LLC

(57) ABSTRACT

A vibrating wrench includes a housing, a driving head, a handle and a vibrating structure. The housing includes a hollow space. The driving head is disposed at one end of the housing. The handle is disposed at the other end of the housing and includes an inner wall and a containing space. The containing space is communicated with the hollow space. The vibrating structure is disposed in the containing space of the handle and includes a vibrating motor and a medium element. The medium element is fully connected or partially connected to an outer surface of the vibrating motor. The inner wall of the handle is fully connected or partially connected to the medium element.

5 Claims, 8 Drawing Sheets

VIBRATING WRENCH

RELATED APPLICATIONS

This application claims priority to U.S. Provisional Application Ser. No. 62/796,096, filed Jan. 24, 2019, which is herein incorporated by reference.

BACKGROUND

Technical Field

The present disclosure relates to a vibrating wrench. More particularly, the present disclosure relates to a vibrating wrench which enhances a vibrating effect of the vibrating wrench.

Description of Related Art

In order to remind the user, a conventional vibrating wrench is achieved to a preset condition of an operation which reminds the user via a vibration. However, in the conventional vibrating wrench, a vibrating motor is connected to the vibrating wrench without medium element, so that the vibration provided from the vibrating motor only transmits a little to the entire vibrating wrench, and most of the vibration of the vibrating motor is wasted. Further, the user usually wears gloves during using the vibrating wrench. Therefore, it is easily for the user to ignore the vibrating effects of the vibrating wrench.

Hence, how to enhance the vibration effects of the vibrating wrench so as to remind the user effectively is a target of the industry.

SUMMARY

The present disclosure provides a vibrating wrench. The vibrating wrench includes a housing, a driving head, a handle and a vibrating structure. The housing includes a hollow space. The driving head is disposed at one end of the housing. The handle is disposed at the other end of the housing and includes an inner wall and a containing space. The containing space is communicated with the hollow space. The vibrating structure is disposed in the containing space of the handle and includes a vibrating motor and a medium element. The medium element is fully connected or partially connected to an outer surface of the vibrating motor. The inner wall of the handle is fully connected or partially connected to the medium element.

BRIEF DESCRIPTION OF THE DRAWINGS

The present disclosure can be more fully understood by reading the following detailed description of the embodiment, with reference made to the accompanying drawings as follows.

DETAILED DESCRIPTION

The embodiment will be described with the drawings. For clarity, some practical details will be described below. However, it should be noted that the present disclosure should not be limited by the practical details, that is, in some embodiment, the practical details is unnecessary. In addition, for simplifying the drawings, some conventional structures and elements will be simply illustrated, and repeated elements may be represented by the same labels.

Figure 1:
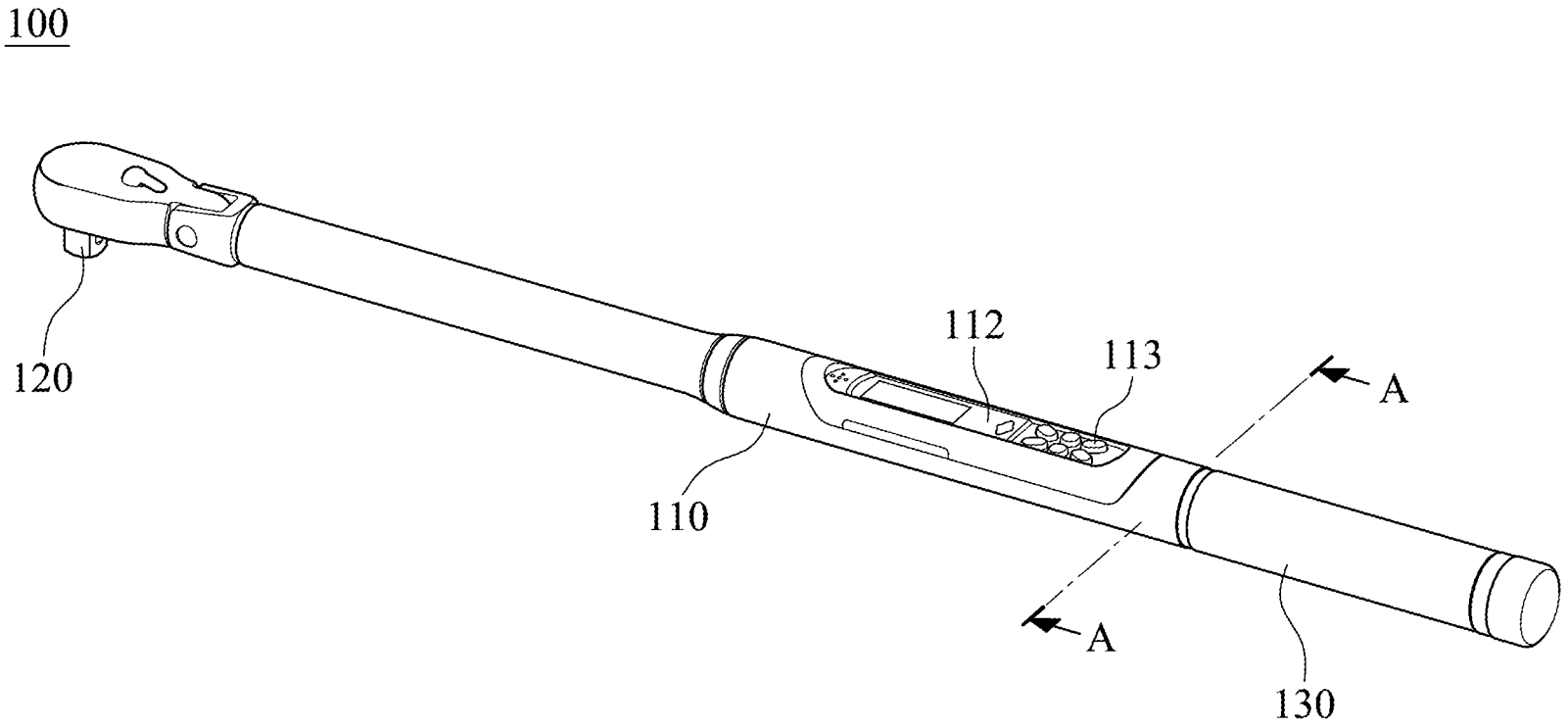
FIG. 1 is a three-dimensional schematic view of a vibrating wrench according to one embodiment of the present disclosure.
Figure 2:
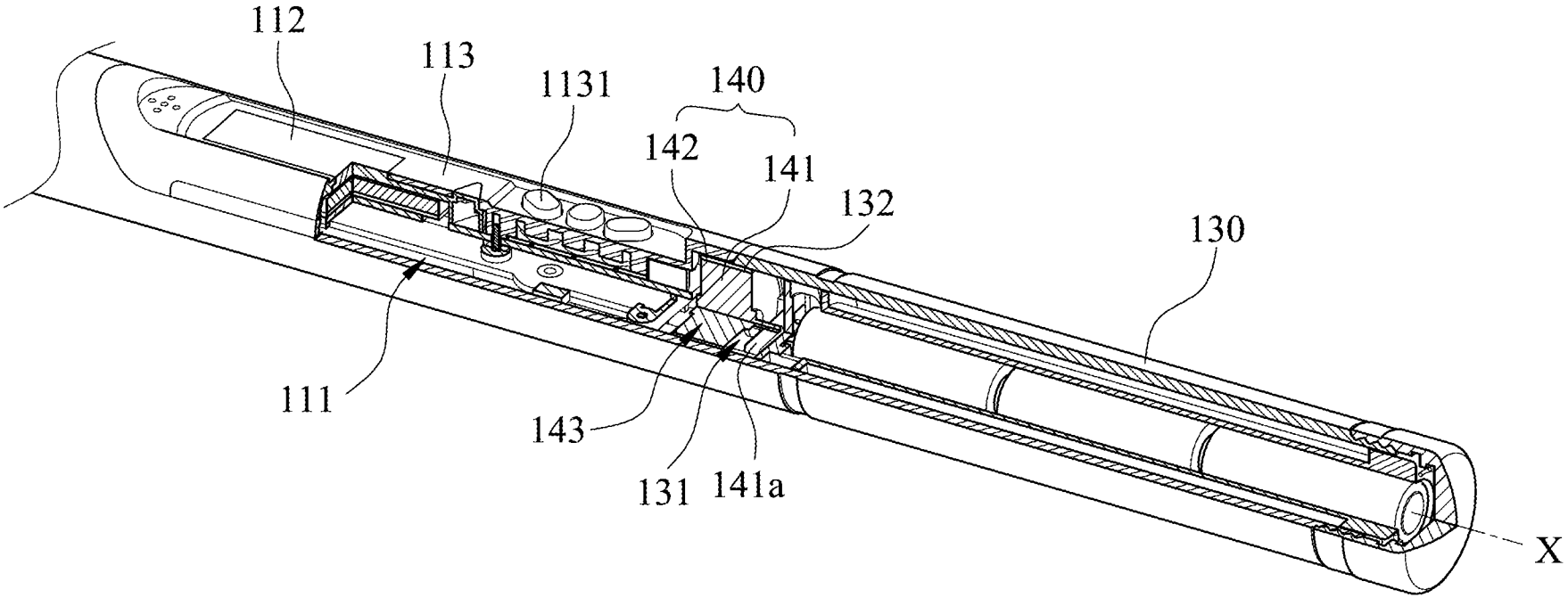
FIG. 2 is a cross-sectional view of the vibrating wrench according to the embodiment of FIG. 1.

FIG. 1 is a three-dimensional schematic view of a vibrating wrench 100 according to one embodiment of the present disclosure. FIG. 2 is a cross-sectional view of the vibrating wrench 100 according to the embodiment of FIG. 1. In FIG. 1 and FIG. 2, the vibrating wrench 100 includes a housing 110, a driving head 120, a handle 130 and a vibrating structure 140. The driving head 120 is disposed at one end of the housing 110. The handle 130 is disposed at the other end of the housing 110. The vibrating structure 140 is disposed in the handle 130.

In detail, the housing 110 includes a hollow space 111. The handle 130 includes a containing space 131 and an inner wall 132. The containing space 131 is communicated with the hollow space 111. The vibrating structure 140 is disposed in the containing space 131 of the handle 130 and includes a vibrating motor 141 and a medium element 142. The medium element 142 is disposed on an outer surface of the vibrating motor 141. The inner wall 132 of the handle 130 is surrounded to the medium element 142. The outer surface of the medium element 142 is connected to the inner wall 132 of the handle 130. In other words, the vibrating motor 141 is disposed in the medium element 142, and the medium element 142 is disposed in the containing space 131 of the handle 130. Therefore, when the vibrating motor 142 is driven, a vibration of the vibrating motor 142 can be transmitted to the handle 130 via the medium element 142.

Figure 3A:
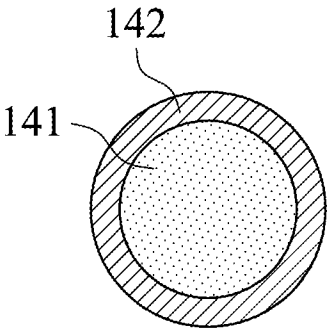
FIG. 3A is a schematic view of a vibrating structure of the vibrating wrench according to a first example of the embodiment of FIG. 1.
Figure 3B:
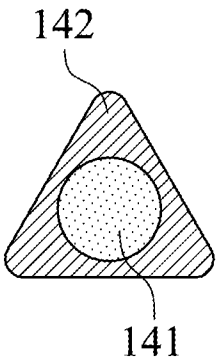
FIG. 3B is a schematic view of a vibrating structure of the vibrating wrench according to a second example of the embodiment of FIG. 1.
Figure 3C:
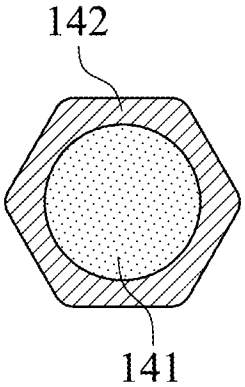
FIG. 3C is a schematic view of a vibrating structure of the vibrating wrench according to a third example of the embodiment of FIG. 1.
Figure 3D:
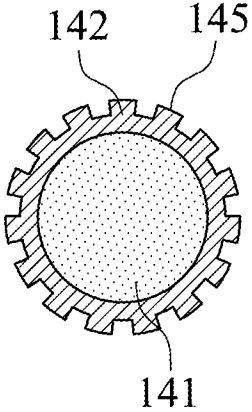
FIG. 3D is a schematic view of a vibrating structure of the vibrating wrench according to a fourth example of the embodiment of FIG. 1.
Figure 3E:
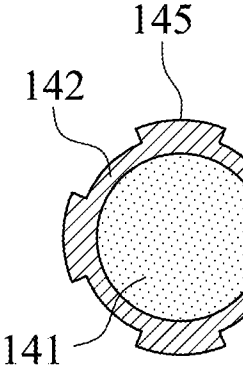
FIG. 3E is a schematic view of a vibrating structure of the vibrating wrench according to a fifth example of the embodiment of FIG. 1.
Figure 3F:
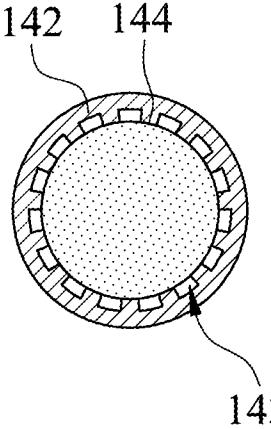
FIG. 3F is a schematic view of a vibrating structure of the vibrating wrench according to a sixth example of the embodiment of FIG. 1.
Figure 3G:
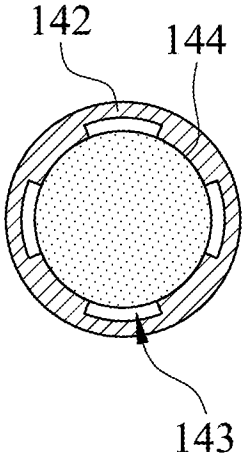
FIG. 3G is a schematic view of a vibrating structure of the vibrating wrench according to a seventh example of the embodiment of FIG. 1.
Figure 3H:
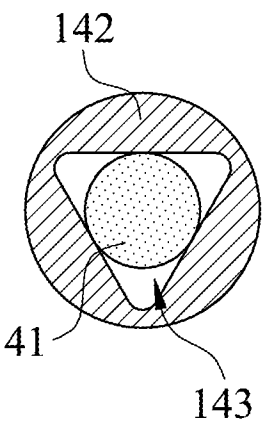
FIG. 3H is a schematic view of a vibrating structure of the vibrating wrench according to an eighth example of the embodiment of FIG. 1.
Figure 3I:
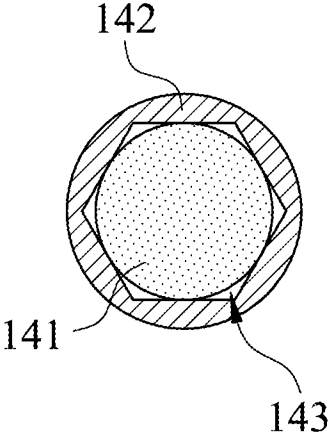
FIG. 3I is a schematic view of a vibrating structure of the vibrating wrench according to a ninth example of the embodiment of FIG. 1.

FIG. 3A is a schematic view of a vibrating structure 140 of the vibrating wrench 100 according to the first example of the embodiment of FIG. 1. FIG. 3B is a schematic view of a vibrating structure 140 of the vibrating wrench 100 according to the second example of the embodiment of FIG. 1. FIG. 3C is a schematic view of a vibrating structure 140 of the vibrating wrench 100 according to the third example of the embodiment of FIG. 1. FIG. 3D is a schematic view of a vibrating structure 140 of the vibrating wrench 100 according to the fourth example of the embodiment of FIG. 1. FIG. 3E is a schematic view of a vibrating structure 140 of the vibrating wrench 100 according to the fifth example of the embodiment of FIG. 1. FIG. 3F is a schematic view of a vibrating structure 140 of the vibrating wrench 100 according to the sixth example of the embodiment of FIG. 1. FIG. 3G is a schematic view of a vibrating structure 140 of the vibrating wrench 100 according to the seventh example of the embodiment of FIG. 1. FIG. 3H is a schematic view of a vibrating structure 140 of the vibrating wrench 100 according to the eighth example of the embodiment of FIG. 1. FIG. 3I is a schematic view of a vibrating structure 140 of the vibrating wrench 100 according to the ninth example of the embodiment of FIG. 1. According to each example of FIGS. 3A-3I, the medium element 142 includes a containing hole 143. The vibrating motor 141 is disposed in the containing hole 143 of the medium element 142. The outer surface of the vibrating motor 141 is connected to an inner surface of the medium element 142. By such arrangement, the outer surface of the vibrating motor 141 directly contacts the inner surface of the medium element 142, and the outer surface of the medium element 142 directly contacts the inner wall 132 of the handle 130. That is, the vibrating motor 141 transmits the vibration to the handle 130 by the medium element 142, and the vibration provided by the vibrating motor 141 can be fully transmitted to the handle 130 due to the direct contact area between the outer surface of the vibrating motor 141 and the inner surface of the medium element 142, and the outer surface of the medium element 142 and the inner wall 132 of the handle 130. Therefore, the vibrating structure 140 can be firmly fixed in the handle 130 so as to avoid the abscission of the vibrating structure 140, and the vibrating effect of the vibrating wrench 100 can be further enhanced.

The containing hole 143 is a circle shape or a polygonal shape. The polygonal shape can be a triangle shape, a square shape or a hexagon shape, but is not limited thereto. In FIG. 3A-3E, the containing hole 143 is the circle shape. In FIG. 3H, the containing hole 143 is the triangle shape. In FIG. 3I, the containing hole 143 is the hexagon shape. When the containing hole 143 is the circle shape, the vibrating motor 141 can fully connected to the medium element 142, so that the vibration provided by the vibrating motor 141 can be fully transmitted due to the direct contact area between the outer surface of the vibrating motor 141 and the inner surface of the medium element 142. When the containing hole 143 is the polygonal shape, the vibrating motor 141 is partially connected to the medium element 142 so that a part of the vibration provided by the vibrating motor 141 can be transmitted due to the direct contact area between the outer surface of the vibrating motor 141 and the inner surface of the medium element 142.

Please refer to FIGS. 3A-3E, when the medium element 142 can be fully connected to the vibrating motor 141, the contacting area between the medium element 142 and the vibrating motor 141 is increased. Therefore, the vibrating motor 141 can be firmly disposed in the containing hole 143 of the medium element 142 so as to avoid the abscission of the vibrating motor 141 and the vibrating effect of the vibrating wrench 100 can be further enhanced.

Please refer to FIGS. 3F and 3G, the medium element 142 further includes a plurality of inner convex parts 144. The number of the inner convex parts 144 can be 4 or 15, but is not limited thereto. In FIG. 3F, the number of the inner convex parts 144 is 15. In FIG. 3G, the number of the inner convex parts 144 is 4. The inner convex parts 144 are disposed on the inner surface of the medium element 142, and connected to an outer surface of the vibrating motor 141. Therefore, the vibrating motor 141 is partially connected to the medium element 142 so that a part of the vibration provided by the vibrating motor 141 can be transmitted due to the direct contact area between the outer surface of the vibrating motor 141 and the inner convex parts 144 of the medium element 142. Moreover, when the medium element 142 is partially connected to the vibrating motor 141, the medium element 142 and the vibrating motor 141 will form a first gap 146 (shown in FIG. 4B) which is between the medium element 142 and the vibrating motor 141.

The medium element 142 is a circle shape or a polygonal shape which is surrounded on the outer surface of the vibrating motor 141. The polygonal shape can be a triangle shape, a square shape or a hexagon shape, but is not limited thereto. In FIGS. 3A and 3F-3I, the medium element 142 is the circle shape. In FIG. 3B, the medium element 142 is the triangle shape. In FIG. 3C, the medium element 142 is the hexagon shape. Therefore, the medium element 142 can be fully connected to the inner wall 132 of the handle 130 or partially connected to the inner wall 132 of the handle 130 so as to enhance the vibrating effect of the vibrating wrench 100.

When the medium element 142 is fully connected to the inner wall 132 of the handle 130, the contacting area between the medium element 142 and the handle 130 are increased. The vibrating structure 140 can be firmly disposed in the containing space 131 of the handle 130. Therefore, the vibrating structure 140 abscission can be avoided and the vibrating effect of the vibrating wrench 100 can be further enhanced.

The medium element 142 includes a plurality of outer convex parts 145. A number of the outer convex parts 145 can be 4 or 15, but is not limited thereto. In FIG. 3D, the number of the outer convex parts 145 is 15. In FIG. 3E, the number of the outer convex parts 145 is 4. The outer convex parts 145 are disposed on an outer surface of the medium element 142, and connected to the inner wall 132 of the handle 130. Therefore, the medium element 142 is partially connected to the inner wall 132 of the handle 130 so that a part of the vibration provided by the vibrating motor 141 can be transmitted to the handle 130 due to the outer convex parts 145 of the medium element 142 and the inner wall 132 of the handle 130. Moreover, when the medium element 142 is partially connected to the inner wall 132 of the handle 130, the medium element 142 and the inner wall 132 of the handle 130 will form a second gap 147 (shown in FIG. 4A) which is between the medium element 142 and the inner wall 132 of the handle 130. The second gap 147 is help for mounting and replacing the vibrating structure 140 into the containing space 131.

Figure 4A:
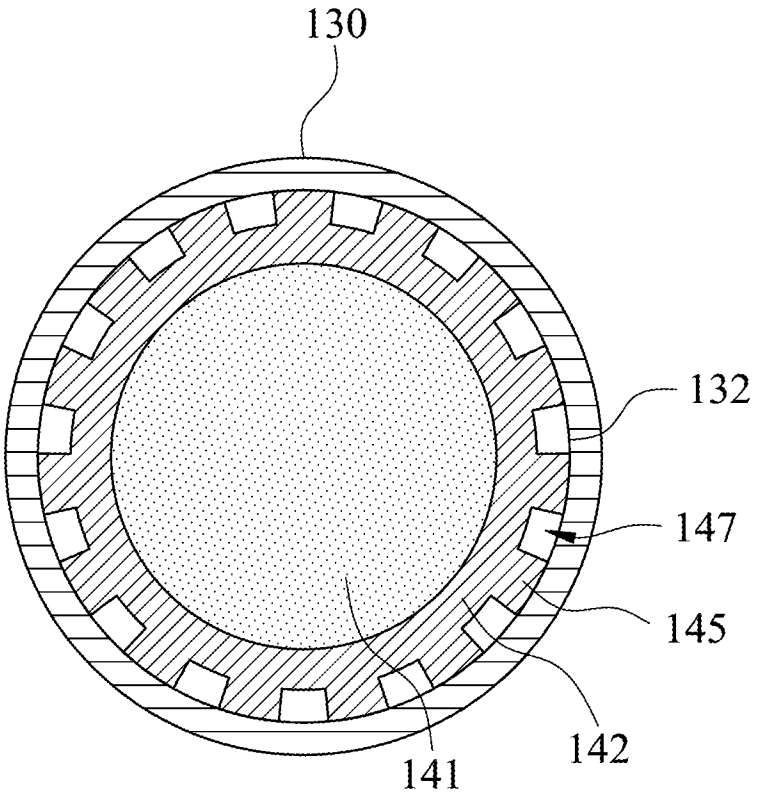
FIG. 4A is a cross-sectional view along line A-A of the vibrating wrench according to another one example of FIG. 1.
Figure 4C:
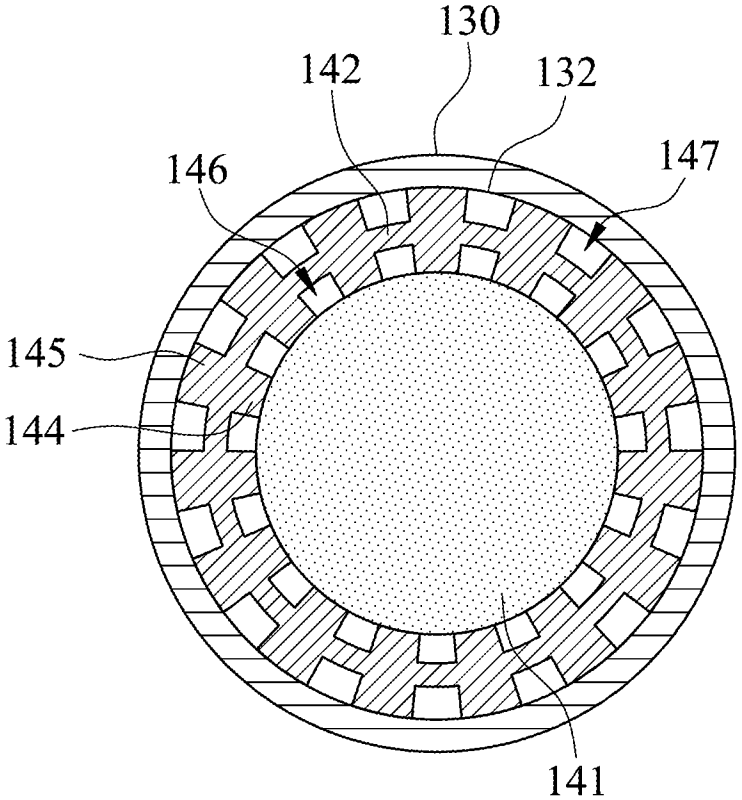
FIG. 4C is a cross-sectional view along line A-A of the vibrating wrench according to still further another one example of FIG. 1.
Figure 4B:
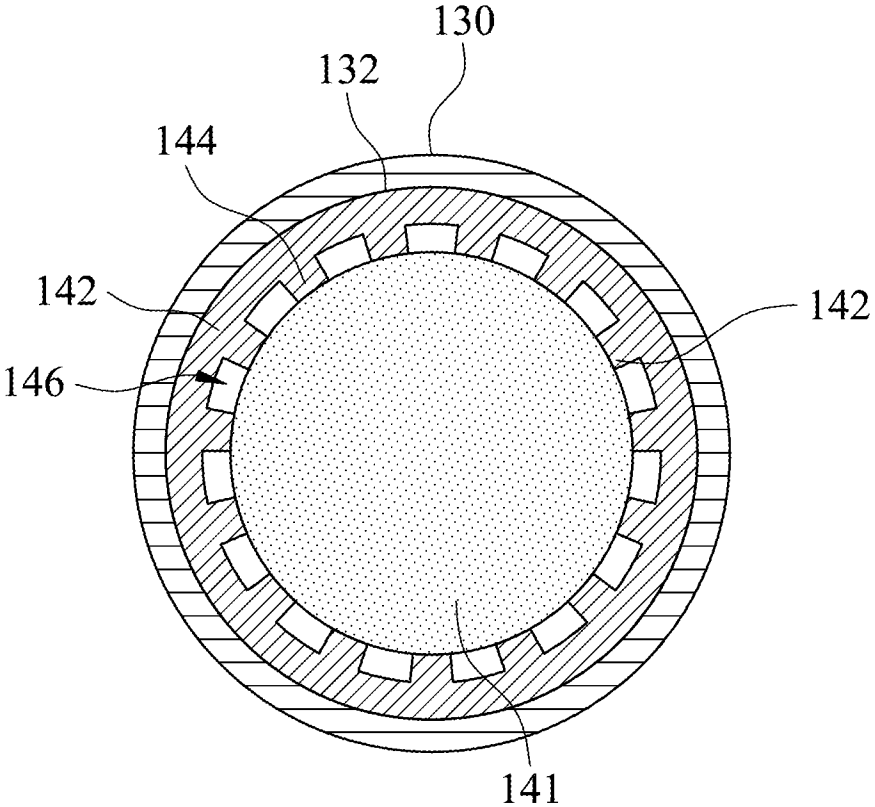
FIG. 4B is a cross-sectional view along line A-A of the vibrating wrench according to further another one example of FIG. 1.

FIG. 4A is a cross-sectional view along line A-A of the vibrating wrench 100 according to another one example of FIG. 1. FIG. 4B is a cross-sectional view along line A-A of the vibrating wrench 100 according to further another one example of FIG. 1. FIG. 4C is a cross-sectional view along line A-A of the vibrating wrench 100 according to still further another one example of FIG. 1. In FIGS. 2 and 3A, the medium element 142 is the circle shape. Because the medium element 142 can be fully connected to the inner wall 132 of the handle 130 and the vibrating motor 141 is fully connected to the medium element 142, the vibrating structure 140 can be firmly fixed in the containing space 131 of the handle 130 so as to avoid the abscission of the vibrating structure 140. Therefore, the vibration provided by the vibrating motor 141 can be fully transmitted to the handle 130 so as to enhance the vibrating effect of the vibrating wrench 100.

In FIG. 4A, the medium element 142 includes the outer convex parts 145. The containing hole 143 is the circle shape. The vibrating motor 141 is the circle shape. The medium element 142 is partially connected to the inner wall 132 of the handle 130, the second gap 147 is formed between the inner wall 132 of the handle 130 and the medium element 142. The second gap 147 can be help for mounting and replacing the vibrating structure 140 into the containing space 131. The vibrating motor 141 is fully connected to the medium element 142, so that the abscission of the vibrating motor 141 can be avoided. Therefore, the vibration provided by the vibrating motor 141 can be transmitted to the handle 130 via the direct contact area between the outer surface of the vibrating motor 141 and the inner surface of the medium element 142, and the outer convex parts 145 of the medium element 142 and the inner wall 132 of the handle 130 so as to enhance the vibrating effect of the vibrating wrench 100.

In FIG. 4B, the medium element 142 includes the inner convex parts 144. The vibrating motor 141 is the circle shape. The vibrating motor 141 is partially connected to the medium element 142, and the first gap 146 is formed between the vibrating motor 141 and the medium element 142. The medium element 142 is fully connected to the inner wall 132 of the handle 130, so that the abscission of the vibrating structure 140 can be avoided. Therefore, the vibrating structure 140 can be firmly fixed in the handle 130 so as to avoid the abscission of the vibrating structure 140, and the vibration provided by the vibrating motor 141 can be transmitted to the handle 130 via the direct contact area between the outer surface of the vibrating motor 141 and the inner convex parts 144 of the medium element 142, and outer surface of the medium element 142 and the inner wall 132 of the handle 130 of the handle 130 so as to enhance the vibrating effect of the vibrating wrench 100.

In FIG. 4C, the medium element 142 includes inner convex parts 144 and the outer convex parts 145. Because the medium element 142 is partially connected to the inner wall 132 of the handle 130, the second gap 147 is formed between the inner wall 132 of the handle and the medium element 142 so as to help the vibrating structure 140 mounted and replaced into the containing space 131. The vibrating motor 141 is partially connected to the medium element 142 so as to form the first gap 146 between the vibrating motor 141 and the medium element 142. Therefore, a part of the vibration provided by the vibrating motor 141 can be uniformly transmitted to the handle 130 via the direct contact area between the outer surface of the vibrating motor 141 and the inner convex parts 144 of the medium element 142, and the outer convex parts 145 of the medium element 142 and the inner wall 132 of the handle 130 so as to enhance the vibrating effect of the vibrating wrench 100.

Figure 5A:
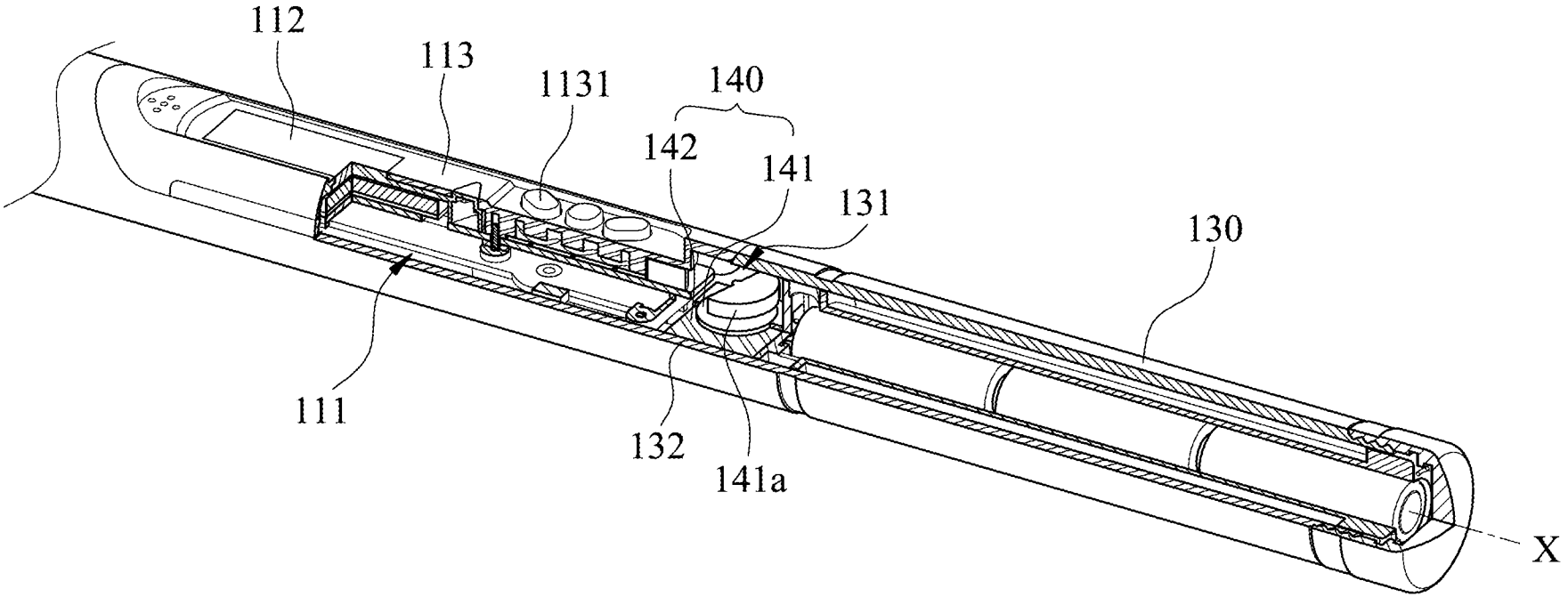
FIG. 5A is a cross-sectional view of a vibrating wrench according to according to another embodiment of the present disclosure.
Figure 5B:
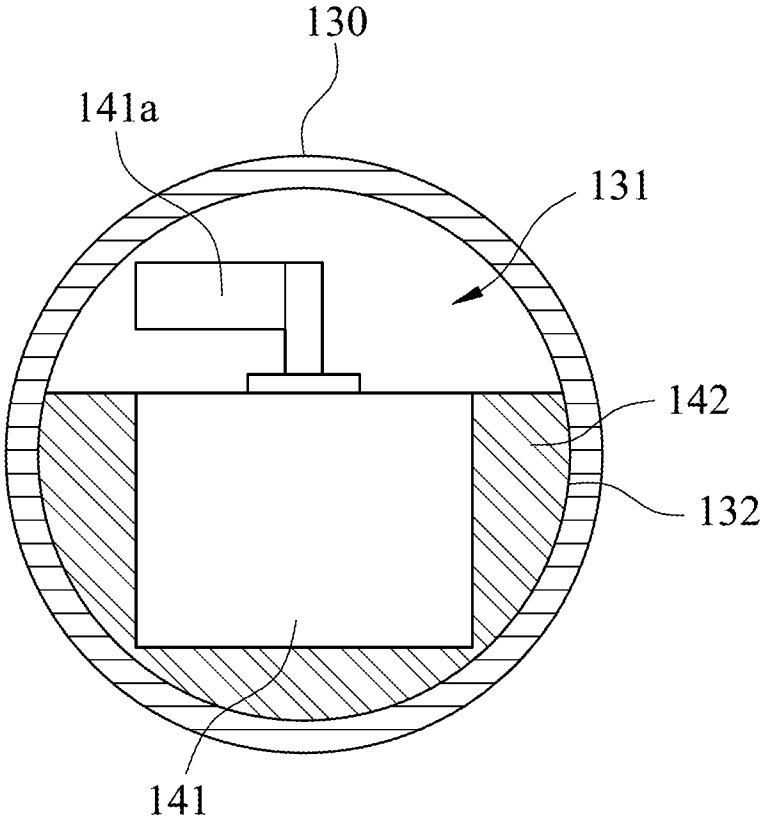
FIG. 5B is a cross-sectional of the vibrating structure of the vibrating wrench of FIG. 5A.

FIG. 5A is a cross-sectional view of a vibrating wrench 100 according to according to another embodiment of the present disclosure. FIG. 5B is a cross-sectional of the vibrating structure 140 of the vibrating wrench 100 of FIG. 5A. Please refer to FIGS. 1, 2, 5A and 5B, a difference between the vibrating wrench 100 in FIG. 2 and the vibrating wrench 100 in FIG. 5A is a disposing direction of the vibrating structure 140. In other words, the vibrating structure 140 can be disposed in the containing space 131 by a vertical direction (shown in FIG. 5A) or a transverse direction (shown in FIG. 2). In FIG. 2, the vibrating structure 140 is disposed in the containing space 131 by the transverse direction. In FIGS. 5A and 5B, the vibrating structure 140 is disposed in the containing space 131 by the vertical direction. In detail, the vibrating wrench 100 has an axle X, and the vibrating motor 141 includes an inertia member 141*a*. The inertia member 141*a* is disposed at one end of the vibrating motor 141. In FIG. 2 the inertia member 141*a* of the vibrating motor 141 is disposed along the axle X, so that the disposing direction of the vibrating structure 140 is the transverse direction. In FIGS. 5A and 5B, the inertia member 141*a* of the vibrating motor 141 is disposed toward the inner wall 132 of the handle 130, so that the disposing direction of the vibrating structure 140 is the vertical direction.

Gives as above, the vibrating structure 140 can be fixed in the containing space 131, firmly. The vibration of the vibrating motor 141 can be transmitted to the handle 130 via the medium element 142 so as to enhance the vibrating effect of the vibrating wrench 100.

Figure 6:
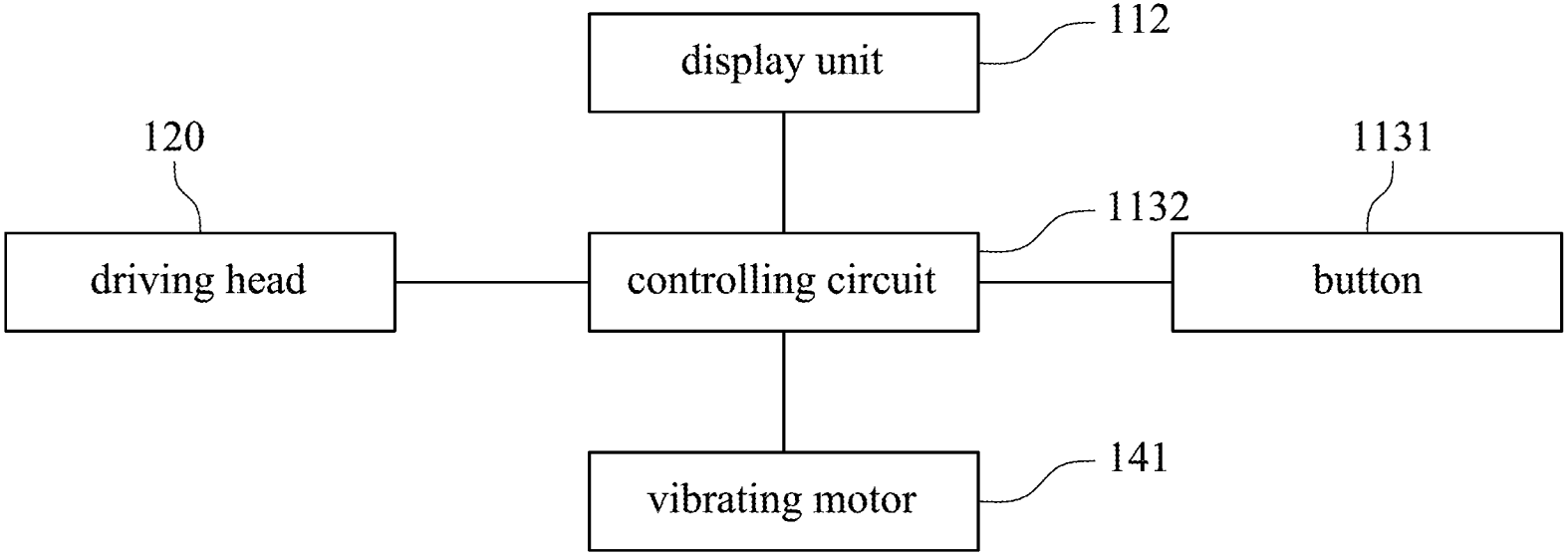
FIG. 6 is a block diagram of the vibrating wrench according to the embodiment of FIG. 1.

FIG. 6 is a block diagram of the vibrating wrench 100 according to the embodiment of FIG. 1. Please refer to FIG. 1, FIG. 2 and FIG. 5A, the vibrating wrench 100 further includes a displaying unit 112 and a controlling device 113. The displaying unit 112 is disposed on an outer surface of the housing 110. The controlling device 113 is disposed on the outer surface of the housing 110. The controlling device 113 includes a button 1131 and a controlling circuit 1132. The button 1131 is electrically connected to the controlling circuit 1132. The controlling circuit 1132 is electrically connected to the driving head 120, the displaying unit 112 and the vibrating motor 141. Therefore, a user can set a warning condition of the vibrating wrench 100 or a vibrating frequency of the vibrating motor 141 via the button 1131, but is not limited thereto. The warning condition of the vibrating wrench 100 can be a torque or a working angle of the vibrating wrench 10, but is not limited thereto. The display unit 112 can shows a working status of the vibrating wrench 100. Therefore, when the vibrating wrench 100 achieves the warning condition of the vibrating wrench 100, the vibrating motor 141 is driven by the controlling circuit 1132 so as to remind the user.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A vibrating wrench, comprising:

a housing, comprising a hollow space;

a driving head disposed at one end of the housing;

a handle disposed at the other end of the housing, and comprising:

an inner wall; and a containing space communicated with the hollow space; and a vibrating structure disposed in the containing space of the handle, and a vibrating motor; and a medium element fully connected or partially connected to an outer surface of the vibrating motor, wherein the inner wall of the handle is fully connected or partially connected to the medium element, and the medium element comprises:

a containing hole, wherein the vibrating motor is disposed in the containing hole;

a plurality of inner convex parts disposed on an inner surface of the medium element, and connected to the outer surface of the vibrating motor; and a plurality of outer convex parts disposed on an outer surface of the medium element, and connected to the inner wall of the handle.

2. The vibrating wrench of claim 1, wherein the containing hole is a circle shape or a polygonal shape.

3. The vibrating wrench of claim 1, wherein the medium element is a circle shape or a polygonal shape.

4. The vibrating wrench of claim 1, further comprising:

a displaying unit disposed on an outer surface of the housing; and a controlling device disposed on the outer surface of the housing.

5. The vibrating wrench of claim 4, wherein the controlling device comprises:

a controlling circuit electrically connected to the driving head, the displaying unit and the vibrating motor.

* * * * *